US006243886B1

(12) United States Patent
Kerwin

(10) Patent No.: US 6,243,886 B1
(45) Date of Patent: Jun. 12, 2001

(54) WATER DISPLACEMENT DEVICE

(75) Inventor: Colin John Kerwin, Bramhall (GB)

(73) Assignee: Kma (U. K.) Limited, Cheshire (GB)

( * ) Notice: Subject to any disclaimer, the term of this patent is extended or adjusted under 35 U.S.C. 154(b) by 0 days.

(21) Appl. No.: 09/248,610

(22) Filed: Feb. 11, 1999

(30) Foreign Application Priority Data

Oct. 16, 1997 (GB) ..... 9721848

(51) Int. Cl.[7] ..... E03D 1/00
(52) U.S. Cl. ..... 4/415
(58) Field of Search ..... 4/415

(56) References Cited

U.S. PATENT DOCUMENTS 3,877,081 * 4/1975 Klein ..... 4/415
5,259,075 * 11/1993 Cutler ..... 4/415
5,419,955 * 5/1995 Ehrhardt et al. ..... 428/283

* cited by examiner

*Primary Examiner*—Charles E. Phillips
(74) *Attorney, Agent, or Firm*—Wolf, Greenfield & Sacks, P.C.

(57) ABSTRACT

A water displacement device for water storage vessels such as toilet tanks, the device comprising a perforated plastics bag including a super-absorbent polymer in granular form which, when wetted, expands to up to two hundred times its pre-absorption volume. The bag may be weighted and may be placed in a toilet tank where it expands to displace between two and five litres of water within a toilet tank otherwise containing at least nine litres of water, thereby reducing wasteful water consumption.

17 Claims, 3 Drawing Sheets

WATER DISPLACEMENT DEVICE

FIELD OF THE INVENTION

The present invention relates to a device for displacement of water in water storage vessels such as toilets.

BACKGROUND OF THE INVENTION

Considerable emphasis is currently placed on savings of water in residential and particularly commercial premises and educational premises. A modem toilet tank contains in excess of six litres of water and many older toilet tanks presently in use generally contain either nine or thirteen litres of water.

The majority of toilet appliances require only six to seven and one-half litres of water per flush and therefore, many appliances waste at least thirty percent of their water content every time the toilet tank is emptied. Not only does this represent a considerable waste of water, which burdens water supplies and waste water treatment plants, but it is also financially wasteful where water usage is measured by a meter, and consumers pay for water according to the volume of usage.

SUMMARY OF THE INVENTION

Reducing the volume of water dispensed from a toilet tank when flushed, allows an appreciable saving in cost and resources. Thus, in one embodiment, a water displacement device for water storage vessels such as toilets, includes a flexible container within which is provided a material which is water-absorbent such as to expand to many times its pre-absorption volume.

In one embodiment, the container is a bag of a plastics material such as polyethylene, and includes a small and compact quantity of a highly absorbent material which is capable of expanding to two hundred or more times its pre-absorption volume when submerged in a water storage tank. The bag may also include a weight so that it sinks to the bottom of the vessel whereby the bag, after expansion of the absorbent material, resides beneath the flotation member attached to the water inlet valve.

DETAILED DESCRIPTION OF THE DRAWINGS

Figure 1:
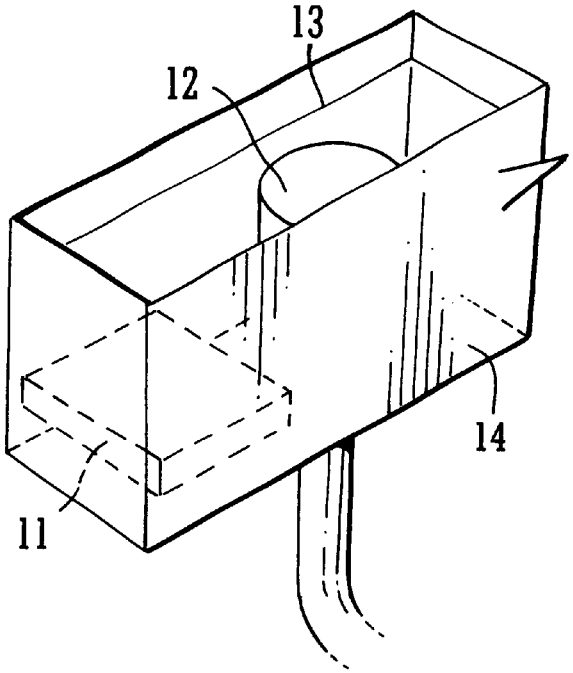
FIG. 1 illustrates a toilet tank in which there is installed a water displacement device shown in a pre-absorption condition, made in accordance with one embodiment of the present invention.
Figure 2:
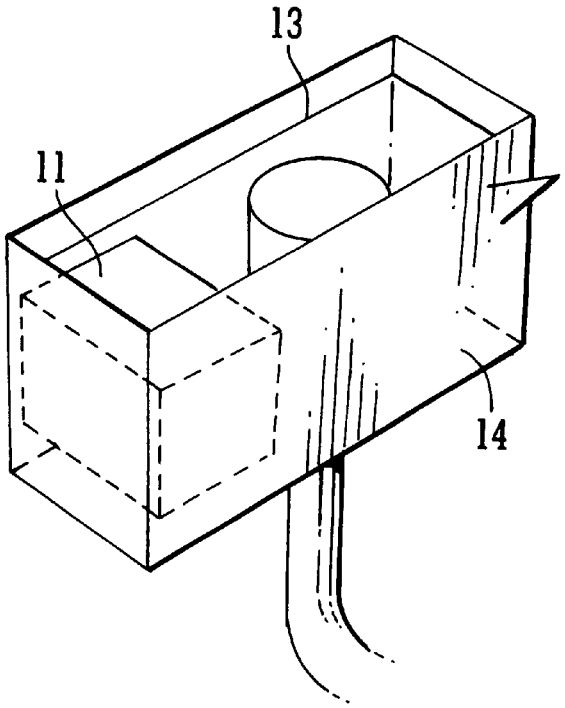
FIG. 2 illustrates the toilet tank of FIG. 1 after absorption.
Figure 3:
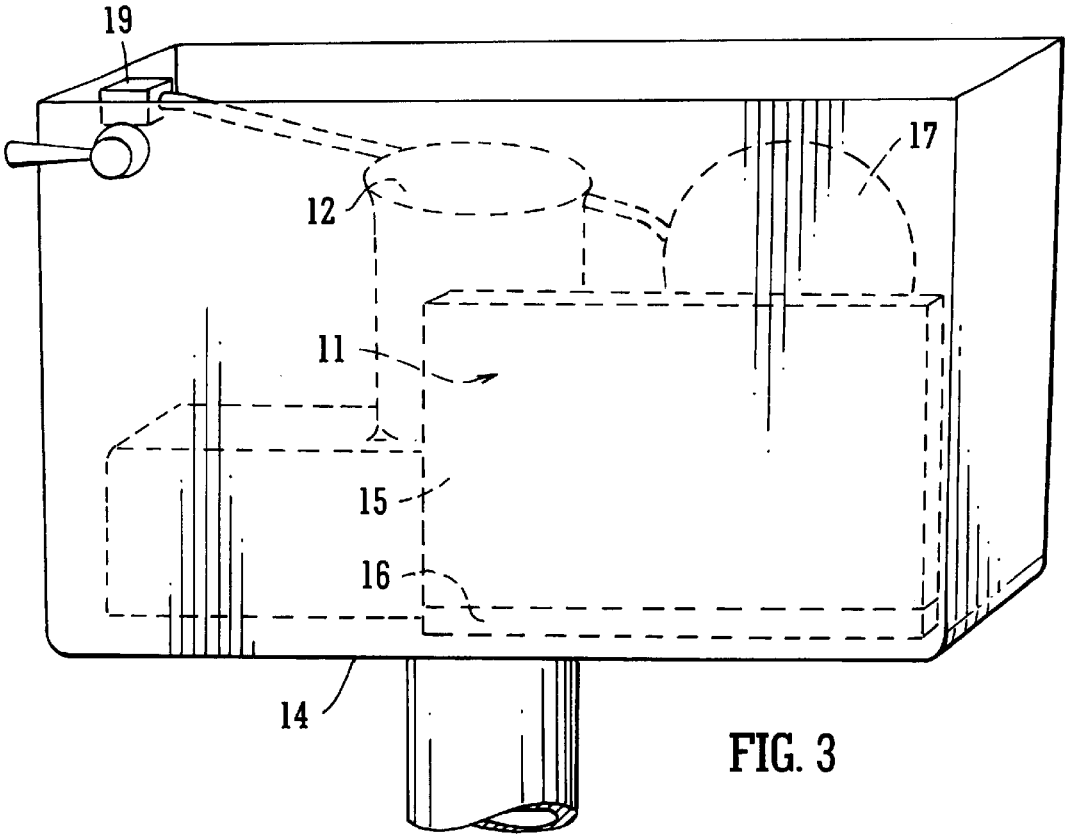
FIG. 3 illustrates, in elevation, a toilet tank containing a water displacement device before absorption, according to one embodiment of the present invention.

Referring now to FIGS. 1 and 2, water storage vessel, i.e., toilet tank 14 contains a flushing siphon 12 and water to a level as illustrated at 13. There is shown introduced into the tank 14 a water displacement device 11 comprising a generally rectilinear block of a material which, in one embodiment, is included within a water-permeable perforated polyethylene bag. As illustrated in FIG. 2, after a period of submersion within the tank 14, the water displacement device expands approximately to four or five times its original volume. The water displacement device may be used in other types of water storage vessels including sanitary installations, and an individual toilet is used only as an example.

An alternate embodiment is shown in FIGS. 3 to 6. In this embodiment, a water displacement device such as bag 11 includes a weight and a small quantity of a super absorbent material which is capable of expansion from up to one hundred to up to two hundred times its volume upon absorption of water. The material may be, for example, a double cross-linked sodium polyacrylate, although other materials may be used. Such a material is SALSORB CL21 or SALSORB CL10 available from Allied Colloids Limited. The super absorbent polymer may be, for example, in granular form and may have an extremely high retention capacity and characteristics such that after expansion, substantially all of its volume is retained. In one embodiment, rewetting, caused by repeated flushes, does not diminish or deteriorate the material which retains a resilient viscous gel-like consistency. In one embodiment, the material is non-toxic and effectively inert in water.

The bag 11 may be constructed of perforated polyethylene having upper and lower compartments 15 and 16. In one embodiment, the lower compartment 16 has a smaller volume than the upper compartment although other configurations may be used. The lower compartment may include a material such as sand, or, for example, a galvanized steel rod, to act as a weight to hold one edge of the bag down on the base of the tank 14. The upper compartment 15 may include a small quantity of the granular super absorbent polymer, which may occupy one-half percent or less of the volume of the compartment 15 upon introduction into the tank.

Figure 4:
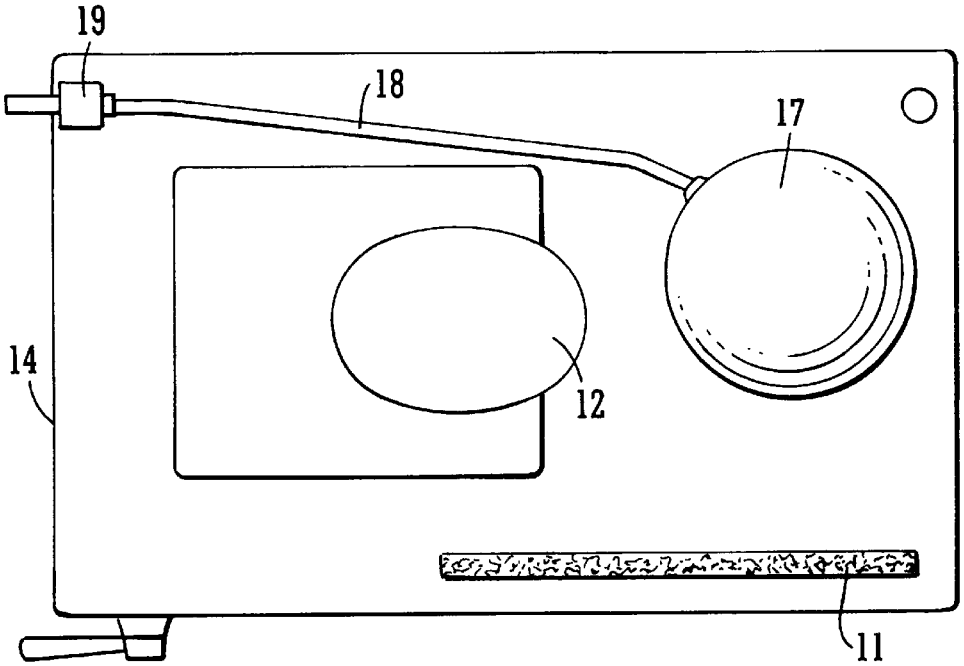
FIG. 4 is a plan view of FIG. 3.

As shown in FIG. 4, the bag 11, when installed, lies alongside the internal front wall of the toilet tank 14, apart from the flush-siphon assembly 12, the float ball 17 and the arm 18 attaching it to a water inlet valve 19.

Figure 5:
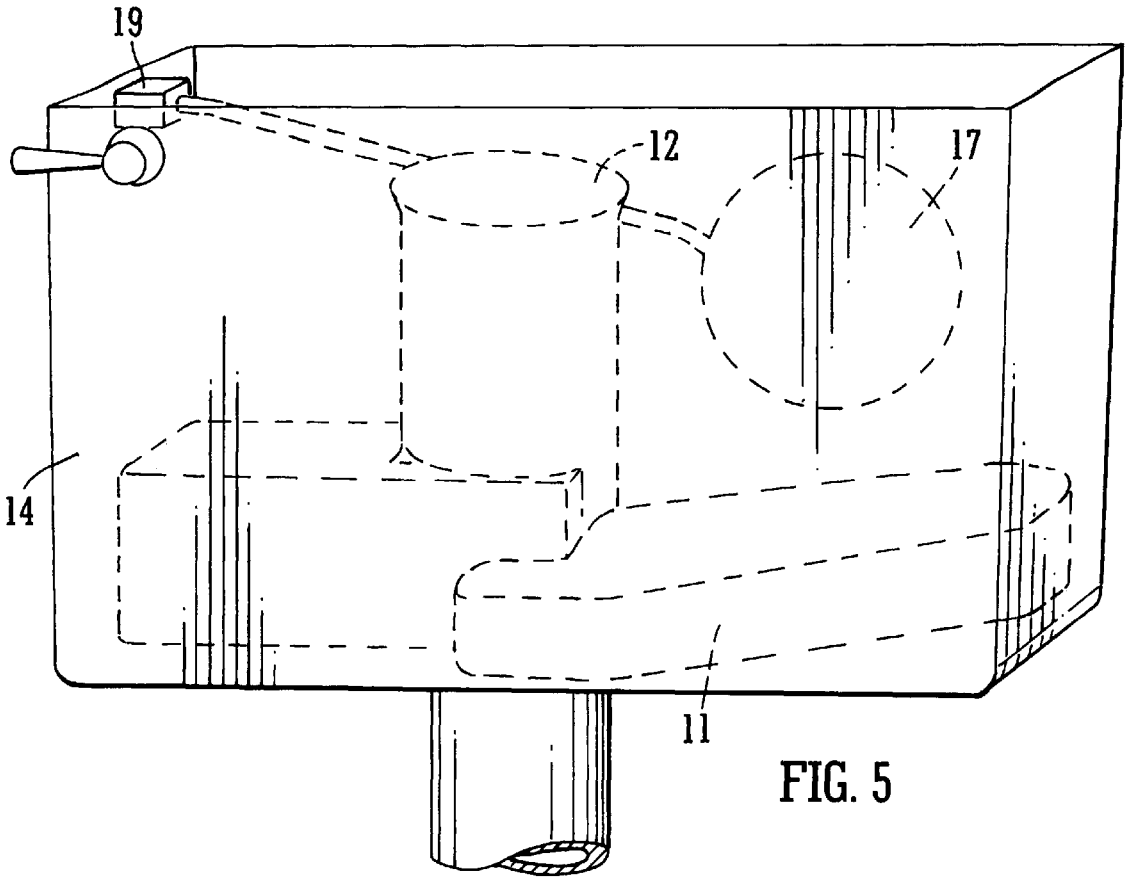
FIG. 5 illustrates, in elevation, the toilet tank of FIG. 3 after absorption.
Figure 6:
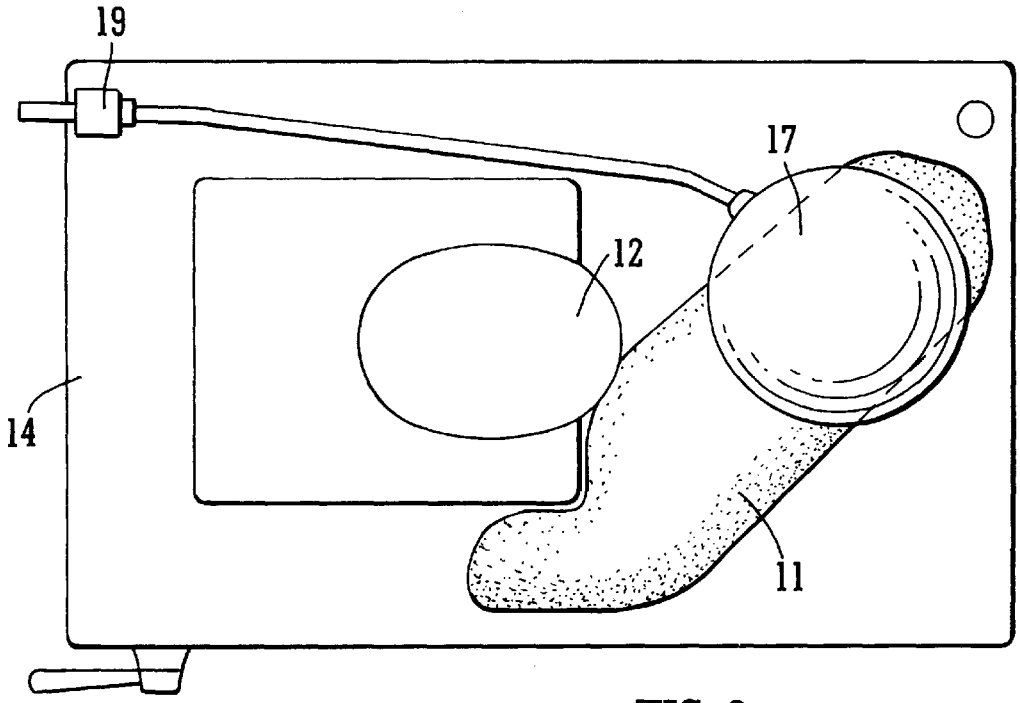
FIG. 6 is a plan view similar to FIG. 4, after absorption.

Referring now to FIGS. 5 and 6, a water displacement device, such as bag 11, is shown after the absorbent material in compartment 15 has expanded to its maximum volume after absorption. Thus, the expanded bag 11 lies across the bottom of the tank 14, with one end of the bag lodged alongside the siphon assembly 12, and the remainder of the bag 11 extending towards an opposite corner of the tank so that the bag 11 lies beneath the float ball 17.

Thus, after absorption of water, the water displacement device, i.e. bag 11, occupies a proportional volume of the water storage vessel, i.e. tank 14, displacing water and reducing the volumetric content by between two and five litres. For example, the capacity of a nine-litre tank may be reduced by this device to seven litres and a thirteen-litre tank to, for example, eight litres. This allows the nine and thirteen-litre tanks to use a volume of water considered to be sufficient for an adequate flush, i.e., approximately seven litres.

A water displacement device according to the embodiments of this invention is easy to install since it requires virtually no skill or tools, is effectively everlasting, and non-intrusive and for tanks with excess capacity, enables a considerable saving of water. In one embodiment, expansion occurs within thirty to sixty minutes after submersion in a water storage vessel and once introduced, it requires no further attention or renewal.

The bag containing the absorbent material may be a perforated plastics material or fabric or any other material which may be conveniently packaged for purchase and which may remain in the water storage vessel once introduced.

While the water-absorbent material is preferably selected in granular form for convenience of packaging, any material which is capable of expansion to many times its pre-absorption volume to displace an adequate volume of water, is envisaged within the scope of this invention.

It is preferable for the device to be installed within a water storage vessel in its non-absorbed and compact form and then allowed to expand around any obstacles within the water storage vessel. However, as an alternative, it may be permitted to expand by the introduction of water prior to installation and may be sealed until required for use.

The device as described herein is advantageous over such known devices for a similar purpose including an open bag or vessel adapted to contain but not release a volume of water, or even a building brick or other solid object simply placed in a toilet tank.

Having thus described several particular embodiments of the invention, various alterations, modifications, and improvements will readily occur to those skilled in the art. Such alterations, modifications, and improvements as are made obvious by this disclosure are intended to be part of this disclosure though not expressly stated herein, and are intended to be within the spirit and scope of the invention. Accordingly, the foregoing description is by way of example only and is not intended to be limiting. The invention is limited only as defined in the following claims and equivalents thereto.

What is claimed is:

1. A water displacement device for water storage vessels such as toilets, the device comprising:

a flexible container constructed and arranged to be placed in a toilet tank, within which is provided a material of the kind which is water-absorbent such as to expand to many times its pre-absorption volume wherein the container is weighted to enable it to sink in water.

2. The water displacement device of claim 1, wherein the flexible container is a perforated plastics bag.

3. The water displacement device of claim 1, wherein the water absorbent material is super absorbent polymer.

4. The water displacement device of claim 3, wherein the polymer is a double cross-linked sodium polyacrylate.

5. The water displacement device of claim 1, wherein the water-absorbent material is adapted to expand to at least one hundred times its pre-absorption volume.

6. The water displacement device of claim 1, wherein the water absorbent material is adapted to expand to two hundred times its pre-absorption volume.

7. A water displacement device for water storage vessels such as toilets, the device comprising:

a flexible container within which is provided a material of the kind which is water-absorbent such as to expand to many times its pre-absorption volume, wherein the container is a two-compartment plastic bag in one compartment of which there is provided a material which causes the container to sink in water, and in the other compartment is the water-absorbent material in the form of a granular polymer.

8. A water displacement device for a water storage vessel comprising:

a water permeable container including water-absorbent material which expands to at least one hundred times its pre-absorption volume when introduced into water, and which substantially maintains its post-absorption volume when rewet; wherein the container is a two-compartment plastic bag, in one compartment of which there is provided a material which causes the container to sink in water, and in the other compartment is provided the water-absorbent material in the form of a granular polymer.

9. The water displacement device of claim 8, wherein the water-absorbent material is adapted to expand to two hundred times its pre-absorption volume.

10. A water displacement device for a toilet comprising:

a water permeable container including water-absorbent material which expands to at least one hundred times its pre-absorption volume when introduced into water, and which substantially maintains its post-absorption volume when rewet.

11. The water displacement device of claim 8, wherein the water permeable container is a perforated plastics bag.

12. The water displacement device of claim 8, wherein the water absorbent material is a super absorbent polymer.

13. The water displacement device of claim 12, wherein the polymer is a double cross-linked sodium polyacrylate.

14. The water displacement device of claim 8, wherein the container is weighted to enable it to sink in water.

15. A method for displacing water in a water storage vessel comprising steps of:

introducing a water permeable container which includes water-absorbent material, into the water storage vessel;

expanding the water absorbent material to at least one hundred times its pre-absorption volume; and substantially maintaining a post-absorption volume of the water absorbent material when water is taken out of, and reintroduced into, the water storage vessel.

16. The method of claim 15, wherein the water absorbent material occupies a small volume of the water permeable container upon introduction into the water storage vessel.

17. The method of claim 15, wherein the water storage vessel is a toilet and the water taken out of, and reintroduced into the toilet, is caused by flushing the toilet.

* * * * *